US011946244B1

(12) United States Patent
Home

(10) Patent No.: US 11,946,244 B1
(45) Date of Patent: Apr. 2, 2024

(54) OFFICE ENVIRONMENT GERM PROTECTION DEVICE

(71) Applicant: Ivan Home, Evanston, IL (US)

(72) Inventor: Ivan Home, Evanston, IL (US)

( * ) Notice: Subject to any disclaimer, the term of this patent is extended or adjusted under 35 U.S.C. 154(b) by 319 days.

(21) Appl. No.: 17/567,997

(22) Filed: Jan. 4, 2022

Related U.S. Application Data

(63) Continuation-in-part of application No. 17/504,620, filed on Oct. 19, 2021.

(51) Int. Cl.
*E04B 1/344* (2006.01)
*E04B 1/343* (2006.01)

(52) U.S. Cl.
CPC ..... *E04B 1/3444* (2013.01); *E04B 1/34321* (2013.01)

(58) Field of Classification Search
CPC ..... E04B 1/3444; E04B 1/34321
See application file for complete search history.

(56) References Cited

U.S. PATENT DOCUMENTS 3,509,810 A 5/1970 Riester
3,632,154 A 1/1972 Woodrich
4,869,446 A 9/1989 Hubert
4,968,171 A * 11/1990 Shell ..... G09F 15/0068 403/387
6,884,002 B1 * 4/2005 Fuller ..... E02B 7/22 52/282.1
7,323,025 B2 1/2008 Weidner
8,007,351 B1 8/2011 Maloney
D858,118 S * 9/2019 Acers ..... D6/332
10,626,602 B2 * 4/2020 Holbrook ..... E04B 2/78
10,760,299 B2 * 9/2020 Preston ..... E04H 17/168
10,889,985 B2 * 1/2021 Wang ..... E04B 2/7437
2002/0087045 A1 7/2002 Perez
2010/0270818 A1 10/2010 Mills
2016/0115704 A1 4/2016 Burke
2017/0231848 A1 8/2017 VanBasten
2018/0128011 A1 * 5/2018 Preston ..... E04H 17/20
2018/0355608 A1 * 12/2018 Holbrook ..... E04B 2/78
2020/0299957 A1 * 9/2020 Wang ..... E04B 2/7438
2022/0056717 A1 * 2/2022 Quagliana Parker ..... E04B 1/34869
2022/0298783 A1 * 9/2022 Shi ..... E04B 1/3445

FOREIGN PATENT DOCUMENTS

CA 2473400 A1 * 1/2005 ..... A61G 10/005

* cited by examiner

*Primary Examiner* — Rodney Mintz

(57) ABSTRACT

The office environment germ protection device comprises a left terminal support, a right terminal support, and one or more barrier panels. The office environment germ protection device may be adapted to be erected vertically on a work surface between a person and one or more other people to isolate the person from exposure to airborne droplets. As non-limiting examples, the work surface may be a desk or a table. The office environment germ protection device may be lengthened or shortened by adding or removing the one or more barrier panels. The one or more barrier panels may be transparent such sightlines are not blocked by the office environment germ protection device.

4 Claims, 5 Drawing Sheets

OFFICE ENVIRONMENT GERM PROTECTION DEVICE

CROSS REFERENCES TO RELATED APPLICATIONS

This application is a continuation-in-part of U.S. application Ser. No. 17/504,620, filed Oct. 19, 2021, which is incorporated by reference herein in its entirety.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of personal protection and medical barriers, more specifically, an office environment germ protection device.

SUMMARY OF INVENTION

The office environment germ protection device comprises a left terminal support, a right terminal support, and one or more barrier panels. The office environment germ protection device may be adapted to be erected vertically on a work surface between a person and one or more other people to isolate the person from exposure to airborne droplets. As non-limiting examples, the work surface may be a desk or a table. The office environment germ protection device may be lengthened or shortened by adding or removing the one or more barrier panels. The one or more barrier panels may be transparent such sightlines are not blocked by the office environment germ protection device.

An object of the invention is to isolate a person from one or more other people in an office environment such that exposure to airborne droplets that may cause disease may be reduced.

Another object of the invention is to provide a vertically-oriented barrier that may stand upon a work surface.

A further object of the invention is to provide hinged intermediate supports that may enable the person to change the footprint of the barrier.

Yet another object of the invention is to lengthen or shorten the barrier by adding or removing intermediate supports and panels.

These together with additional objects, features and advantages of the office environment germ protection device will be readily apparent to those of ordinary skill in the art upon reading the following detailed description of the presently preferred, but nonetheless illustrative, embodiments when taken in conjunction with the accompanying drawings.

In this respect, before explaining the current embodiments of the office environment germ protection device in detail, it is to be understood that the office environment germ protection device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the office environment germ protection device.

It is therefore important that the claims be regarded as including such equivalent construction insofar as they do not depart from the spirit and scope of the office environment germ protection device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
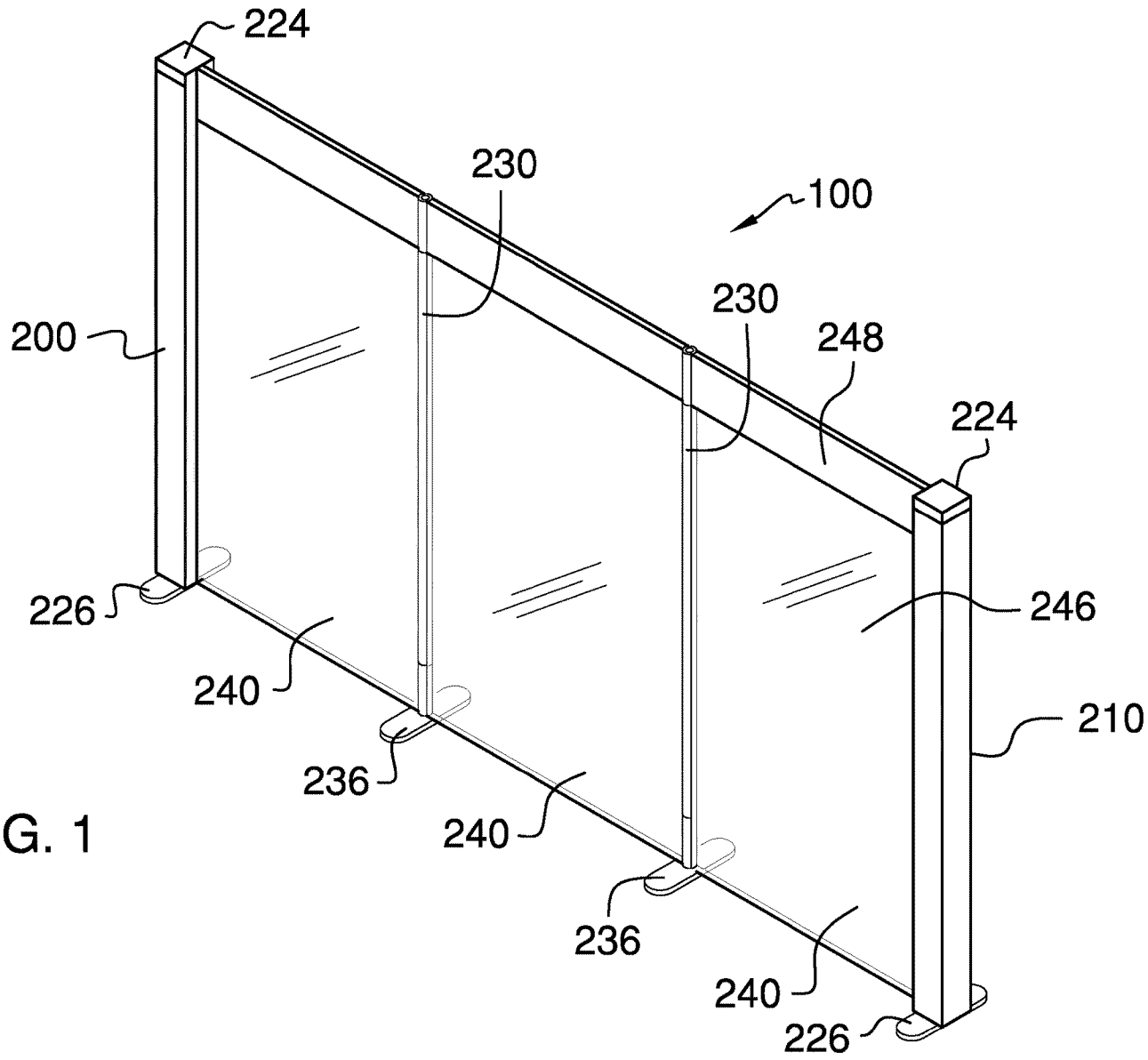
FIG. 1 is an isometric view of an embodiment of the disclosure.
Figure 2:
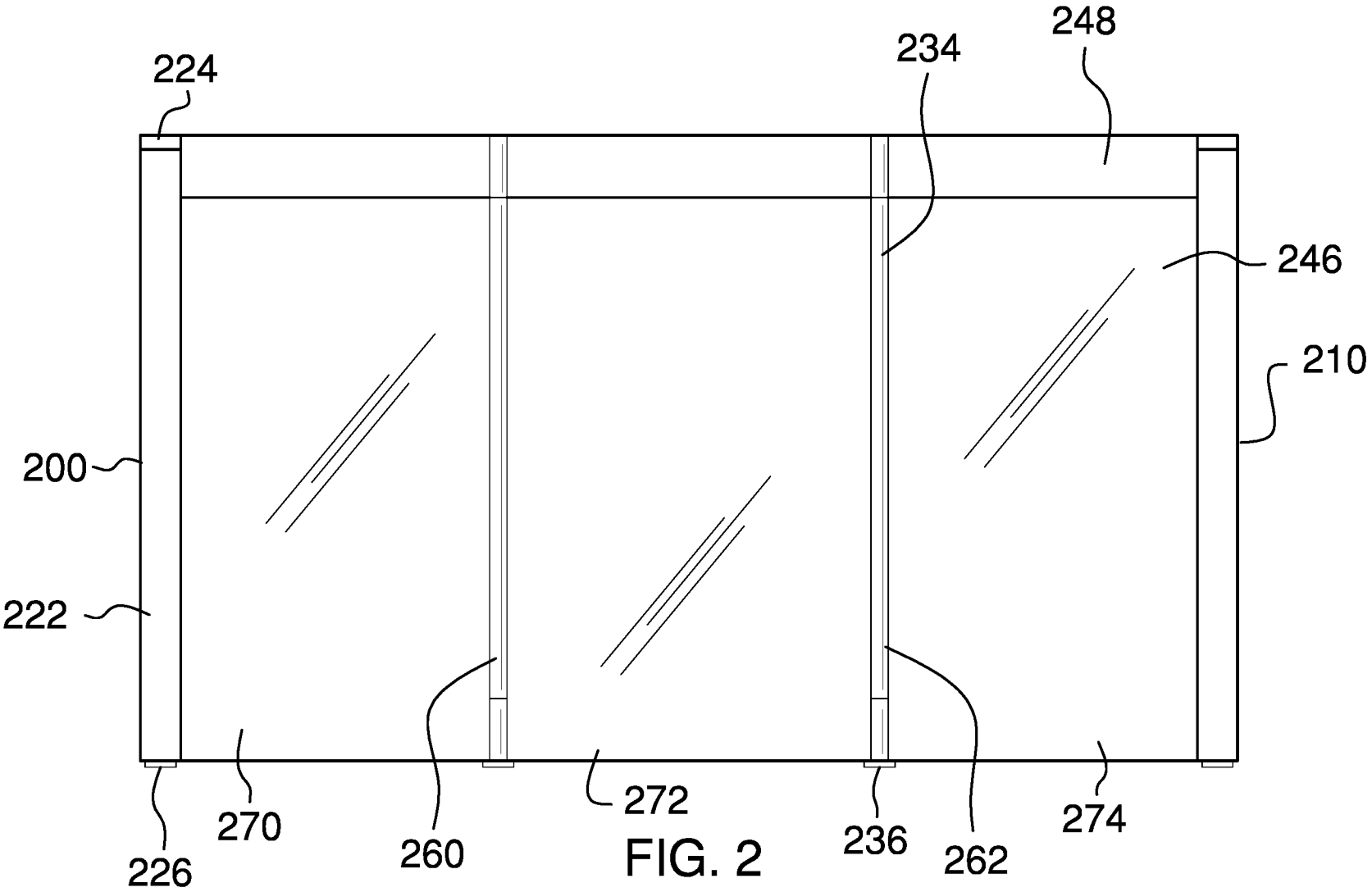
FIG. 2 is a front view of an embodiment of the disclosure.
Figure 3:
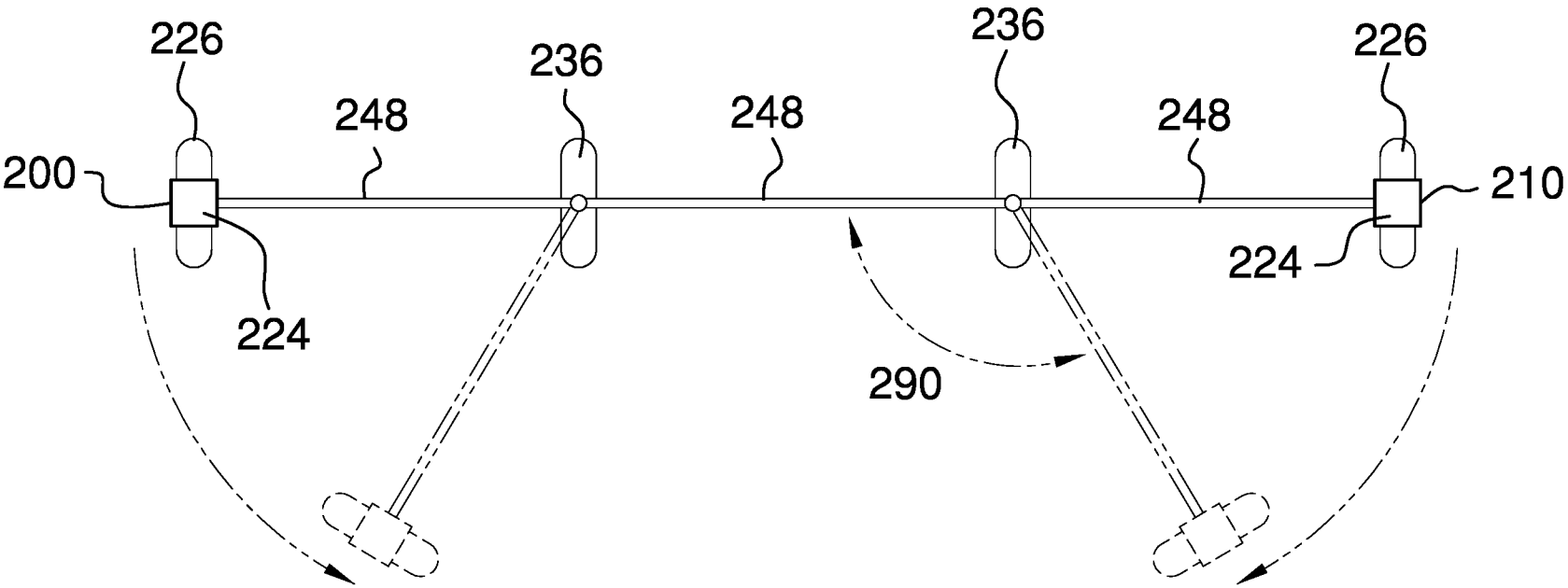
FIG. 3 is a top view of an embodiment of the disclosure.
Figure 4:
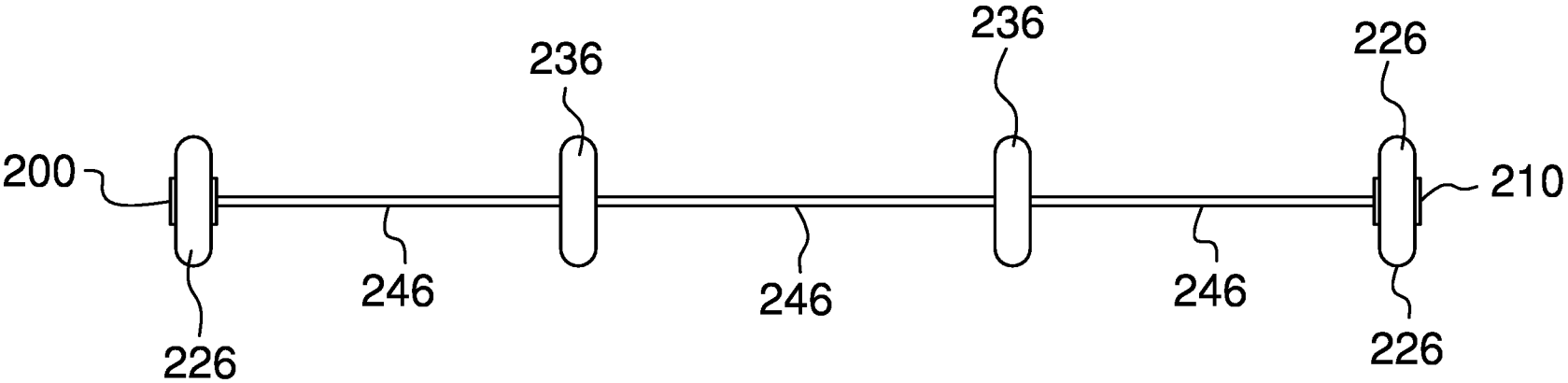
FIG. 4 is a bottom view of an embodiment of the disclosure.
Figure 5:
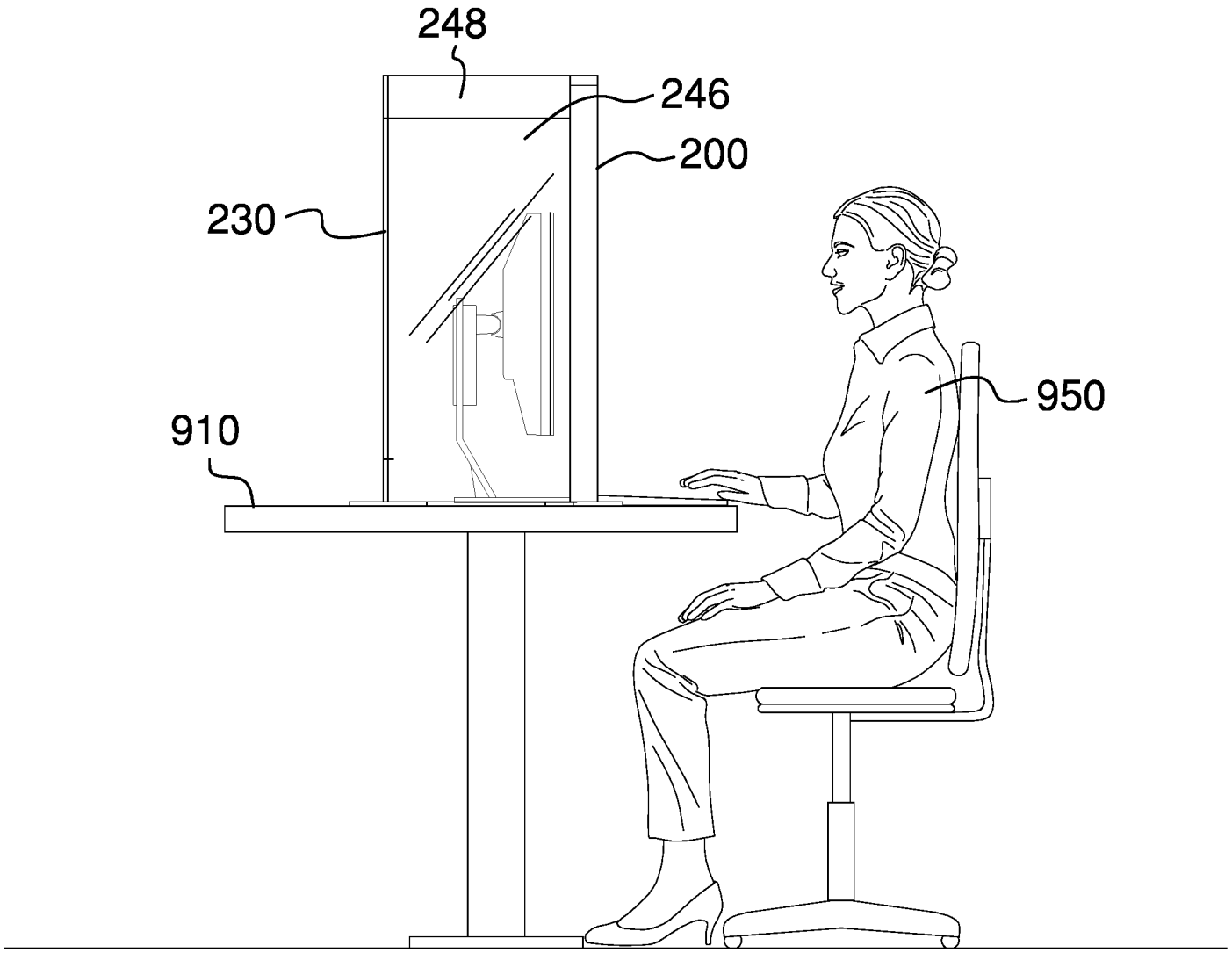
FIG. 5 is an in-use view of an embodiment of the disclosure.

Detailed reference will now be made to a first potential embodiment of the disclosure, which is illustrated in FIGS. 1 through 5.

The office environment germ protection device 100 (hereinafter invention) comprises a left terminal support 200, a right terminal support 210, and one or more barrier panels 240. The invention 100 may be adapted to be erected vertically on a work surface 910 between a person 950 and one or more other people to isolate the person 950 from exposure to airborne droplets. As non-limiting examples, the work surface 910 may be a desk or a table. The invention 100 may be lengthened or shortened by adding or removing the one or more barrier panels 240. The one or more barrier panels 240 may be transparent such sightlines are not blocked by the invention 100.

The left terminal support 200 and the right terminal support 210 may define endpoints of the invention 100. An individual terminal support selected from the left terminal support 200 and the right terminal support 210 may be a vertically-oriented column that may rest on the work surface 910. The individual terminal support may couple to one of individual barrier panels and may hold the individual barrier panel in a vertical orientation.

The individual terminal support may comprise a terminal support body 222, a terminal support top cap 224, and a terminal support foot 226. The terminal support body 222 may couple to the individual barrier panel and may define the height of the invention 100. The terminal support top cap 224 may cover the top of the terminal support body 222 to prevent objects from being dropped into the terminal support body 222 and for decorative purposes. The terminal support foot 226 may couple to the bottom of the terminal support body 222 and may project horizontally in opposing directions from the center of the terminal support foot 226. The terminal support foot 226 may widen the footprint of the terminal support body 222 thus increasing stability. The terminal support foot 226 may increase traction between the individual terminal support and the work surface 910.

The one or more barrier panels 240 may be adapted to block the passage of the airborne droplets from the person 950 to the one or more other people, or vice versa.

The individual barrier panel selected from the one or more barrier panels 240 may comprise a transparent pane 246. As non-limiting examples, the individual barrier panel may be made from acrylic plastic, polycarbonate plastic, or other transparent thermoplastics. The individual barrier panel may further comprise a top brace 248. The top brace 248 may be a horizontal armature located at the top of the transparent pane 246 that may support the top of the individual barrier panel and may prevent flexing of the individual barrier panel.

The invention 100 may further comprise one or more intermediate supports 230. The one or more intermediate supports 230 may be vertically-oriented columns that rest on the work surface 910 at locations between the left terminal support 200 and the right terminal support 210. The one or more intermediate supports 230 may hingedly couple the one or more barrier panels 240.

An individual intermediate support selected from the one or more intermediate supports 230 may comprise an intermediate support body 234 and an intermediate support foot 236. The intermediate support body 234 may hingedly couple to two of the individual barrier panels. The height of the intermediate support body 234 may match the heights of the left terminal support 200 and the right terminal support 210. The intermediate support foot 236 may couple to the bottom of the intermediate support body 234 and may project horizontally in opposing directions from the center of the intermediate support foot 236. The intermediate support foot 236 may widen the footprint of the intermediate support body 234 thus increasing stability. The intermediate support foot 236 may increase traction between the individual intermediate support and the work surface 910.

The individual intermediate support may be configured to couple to two barrier panels and to enable pivoting of the two barrier panels relative to each other. The two barrier panels may be configured to extend in opposite directions from each other to form a planar barrier surface with an angle between panels 290 measuring 180 degrees. Each of the individual barrier panels selected from the two barrier panels may be pivoted until the angle between panels 290 reaches a predetermined angular limit. In some embodiments, the predetermined angular limit may be 90 degrees. Put more simply, the two barrier panels may bend to form a right angle.

The invention 100 is modular and may be lengthened or shortened as needed. As a non-limiting example, the invention 100 may comprise the left terminal support 200, a first barrier panel 270, and the right terminal support 210 as a first configuration. The first configuration may form a planar barrier with no ability to bend.

As a non-limiting example, the invention 100 may comprise the left terminal support 200, the first barrier panel 270, a first intermediate support 260, a second barrier panel 272, and the right terminal support 210 as a second configuration. The second configuration may form a barrier that may be positioned to be planar or may be positioned to form a V-shape, including a right angle.

As a non-limiting example, the invention 100 may comprise the left terminal support 200, the first barrier panel 270, the first intermediate support 260, the second barrier panel 272, a second intermediate support 262, a third barrier panel 274, and the right terminal support 210 as a third configuration. The third configuration may form a barrier that may be positioned to be planar or may be positioned to form a zig-zag shape or a U-shape.

In addition to the non-limiting examples described above, additional panels and intermediate supports may be added to form longer barriers with more ability to bend.

In use, the right terminal support 210 and the left terminal support 200 may be coupled to one or more barrier panels 240 to form an upright barrier between a person 950 and one or more other people. In some embodiments, the invention 100 may be extended by adding the individual intermediate supports and the individual barrier panels to lengthen the invention 100 and to provide opportunities to bend the invention 100. The invention 100 may also be shortened, if necessary, by removing the individual intermediate supports and the individual barrier panels.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, a "brace" may be a structural element that is used to support or otherwise steady an object.

As used herein, the words "couple", "couples", "coupled" or "coupling", may refer to connecting, either directly or indirectly, and does not necessarily imply a mechanical connection.

As used in this disclosure, "decorative" may be an adjective that refers to a first object or item that is used with a second object or item of the purpose of making the second object or item more attractive and/or more distinct. Decorative will generally, but not necessarily, imply making the second object or item more attractive visually.

As used here, "footprint" may refer to a projection of an object onto the surface that supports the object. The projection is usually, but not always, vertically downward.

As used in this disclosure, a "hinge" may be a device that permits the turning, rotating, or pivoting of a first object relative to a second object.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, the term "intermediate" may refer to a location that lies between a first object and a second object As used in this disclosure, "orientation" may refer to the positioning and/or angular alignment of a first object relative to a second object or relative to a reference position or reference direction.

As used in this disclosure, "vertical" may refer to a direction that is parallel to the local force of gravity. Unless specifically noted in this disclosure, the vertical direction is always perpendicular to horizontal.

As used herein, "zig-zag" may refer to a line or course that alternately turns left and right.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An office environment germ protection device consisting essentially of:

a left terminal support, a right terminal support, and one or more individual barrier panels removably connected therebetween;

wherein the office environment germ protection device is configured to be erected vertically on a work surface between a person and one or more other people to isolate the person from exposure to airborne droplets;

wherein the office environment germ protection device is lengthened by adding respective panels to the one or more individual barrier panels or shortened by removing respective panels;

wherein the one or more individual barrier panels are transparent such that sightlines are not blocked by the office environment germ protection device;

wherein the left terminal support and the right terminal support define endpoints of the office environment germ protection device;

wherein an individual terminal support selected from the left terminal support and the right terminal support is a vertically-oriented column that rests on the work surface;

wherein the individual terminal support couples to one of the individual barrier panels and holds the individual barrier panel in a vertical orientation;

wherein the individual terminal support comprises a terminal support body, a terminal support top cap, and a terminal support foot;

wherein the terminal support body couples to the individual barrier panel and defines a height of the office environment germ protection device;

wherein the terminal support top cap covers top of the terminal support body to prevent objects from being dropped into the terminal support body and for decorative purposes;

wherein the terminal support foot couples to bottom of the terminal support body and projects horizontally in opposing directions from center of the terminal support foot;

wherein the terminal support foot widens footprint of the terminal support body thus increasing stability;

wherein the terminal support foot increases traction between the individual terminal support and the work surface;

wherein the one or more barrier panels are configured to block passage of the airborne droplets from the person to the one or more other people, or vice versa;

wherein the individual barrier panel selected from the one or more barrier panels comprises a transparent pane;

wherein the individual barrier panel further comprises a top brace;

wherein the top brace is a horizontal armature located at top of the transparent pane that supports top of the individual barrier panel and prevents flexing of the individual barrier panel;

wherein the office environment germ protection device further comprises one or more intermediate supports;

wherein the one or more intermediate supports are vertically-oriented columns that rest on the work surface at locations between the left terminal support and the right terminal support;

wherein the one or more intermediate supports are hingedly coupled to the one or more barrier panels;

wherein an individual intermediate support selected from the one or more intermediate supports comprises an intermediate support body and an intermediate support foot;

wherein the intermediate support body hingedly couples to two of the individual barrier panels;

wherein a height of the intermediate support body matches each height of the left terminal support and the right terminal support;

wherein the intermediate support foot couples to bottom of the intermediate support body and projects horizontally in opposing directions from center of the intermediate support foot;

wherein the intermediate support foot widens footprint of the intermediate support body thus increasing stability;

wherein the intermediate support foot increases traction between the individual intermediate support and the work surface;

wherein the individual intermediate support is configured to couple to two of the individual barrier panels and to enable pivoting of the two individual barrier panels relative to each other;

wherein the two individual barrier panels are configured to extend in opposite directions from each other to form a planar barrier surface with an angle between panels measuring 180 degrees;

wherein each of the individual barrier panels selected from the two individual barrier panels are configured to pivot until the angle therebetween reaches a predetermined angular limit of 90 degrees.

2. The office environment germ protection device according to claim 1 wherein the office environment germ protection device defines a first configuration;

wherein the first configuration forms a planar barrier with no ability to bend.

3. The office environment germ protection device according to claim 1 wherein the office environment germ protection device defines a second configuration;

wherein the second configuration forms a barrier that is positioned to be planar or is positioned to form a V-shape, including a right angle.

4. The office environment germ protection device according to claim 1 wherein the office environment germ protection device defines a third configuration;

wherein the third configuration forms a barrier that is positioned to be planar or is positioned to form a zig-zag shape or a U-shape.

* * * * *